US010219979B2

(12) United States Patent
Park

(10) Patent No.: US 10,219,979 B2
(45) Date of Patent: Mar. 5, 2019

(54) ACUPRESSURE APPARATUS

(71) Applicants: Kil Hwan Park, Leonia, NJ (US); Kyu Sung Park, Leonia, NJ (US); Kyu Min Park, Leonia, NJ (US)

(72) Inventor: Kil Hwan Park, Leonia, NJ (US)

(73) Assignees: Kil Hwan Park, Leonia, NJ (US); Kyu Sung Park, Leonia, NJ (US); Kyu Min Park, Leonia, NJ (US)

( * ) Notice: Subject to any disclaimer, the term of this patent is extended or adjusted under 35 U.S.C. 154(b) by 638 days.

(21) Appl. No.: 14/849,921

(22) Filed: Sep. 10, 2015

(65) Prior Publication Data

US 2017/0071824 A1 Mar. 16, 2017

(51) Int. Cl.
*A61H 23/02* (2006.01)
*A61H 35/00* (2006.01)
(Continued)

(52) U.S. Cl.
CPC ..... *A61H 39/04* (2013.01); *A61H 23/02* (2013.01); *A61H 35/006* (2013.01); *A61H 33/6026* (2013.01); *A61H 33/6068* (2013.01); *A61H 2201/0111* (2013.01); *A61H 2201/0119* (2013.01); *A61H 2201/0149* (2013.01); *A61H 2201/0207* (2013.01); *A61H 2201/0214* (2013.01); *A61H 2201/0228* (2013.01); *A61H 2201/164* (2013.01); *A61H 2201/1633* (2013.01); *A61H 2201/5007* (2013.01);
(Continued)

(58) Field of Classification Search
CPC .... A61H 2201/0119; A61H 2201/0149; A61H 2201/0207; A61H 2201/0214; A61H 2201/0228; A61H 2201/1633; A61H 2201/164; A61H 2201/5007; A61H 2201/5082; A61H 2203/0431; A61H 33/6068; A61H 33/6026; A61H 35/006; A61H 39/04; A61H 2205/12; A61H 23/02
See application file for complete search history.

(56) References Cited

U.S. PATENT DOCUMENTS 6,317,903 B1 * 11/2001 Brunelle ..... A61H 33/02 4/541.1
6,602,212 B1 * 8/2003 Ahn ..... A61H 33/6057 4/541.6
(Continued)

FOREIGN PATENT DOCUMENTS

WO WO 9742926 A1 * 11/1997 ..... A61H 9/00

*Primary Examiner* — Joshua Lee
(74) *Attorney, Agent, or Firm* — Park & Associates IP Law, P.C.

(57) ABSTRACT

An acupressure apparatus includes a tub configured to receive the user's feet for acupressure treatment, an acupressure station having a pair of designated foot placing areas for facilitating accurate positioning of the feet on the acupressure station, a plurality of upward projections formed on an upper surface of the acupressure station, and a plurality of watering holes formed around the projections, and a water supply conduit connected to the bottom wall of the tub for supplying compressed water by operation of a water pump. The watering holes formed in the acupressure station are directed to acupressure points of the feet such that the compressed water delivered through the watering holes provides acupressure stimulations to the acupressure points of the feet.

15 Claims, 8 Drawing Sheets

(51) Int. Cl.
*A61H 39/04* (2006.01)
*A61H 33/00* (2006.01)

(52) U.S. Cl.
CPC ..... *A61H 2201/5082* (2013.01); *A61H 2203/0431* (2013.01); *A61H 2205/065* (2013.01); *A61H 2205/12* (2013.01)

(56) References Cited

U.S. PATENT DOCUMENTS

| | | | | |
|---|---|---|---|---|
| 6,973,683 | B2 * | 12/2005 | Lev | A47K 3/022 4/541.2 |
| 7,380,294 | B2 * | 6/2008 | Lev | A61H 33/027 4/622 |
| 2003/0220593 | A1 * | 11/2003 | Morton | A61H 35/006 601/15 |
| 2009/0030355 | A1 * | 1/2009 | Gay | A61H 35/006 601/166 |
| 2009/0089924 | A1 * | 4/2009 | Jan | A61H 33/025 4/541.5 |

* cited by examiner

ACUPRESSURE APPARATUS

FIELD OF THE INVENTION

The present invention relates to a system and apparatus for providing massage and therapeutic effects to a human body by applying acupressure treatments to a body part of a user. More particularly, the present invention relates to an acupressure system capable of providing acupressure massage effects onto the human feet by applying a pressurized water spray through a plurality of nozzle holes oriented to acupressure points of the body part, in particular, the feet, thereby, providing therapeutic and healing effects to the human body. The effects may include soothing and relaxation of the body and mind, promoting blood circulation, reducing body pains, and relieving abnormal symptoms and curing diseases, and so on.

BACKGROUND OF THE INVENTION

Acupressure is recognized as an old oriental therapy and healing method which originated in Asia a long time ago. It uses the same or similar principles as acupuncture, but does not use needles for the treatment. Acupressure typically utilizes the technique pressing acupressure points on the human body, such as the feet, hands, and face, etc.

According to the oriental medical principles, the feet and hands of the human body include corresponding points or regions that are connected to all important organs of the body, and typical oriental acupressure techniques (or reflexology techniques) address effective methods on how to apply a suitable amount of pressure on specific points on the body parts to promote human health or prevent diseases, based on the knowledge that applying pressure on such pressure points for a certain duration helps the circulation of the energy and blood flow in the human body and corresponding organs thereof.

FIG. 9 illustrates a foot reflexology chart showing acupressure points or acupressure regions in the feet, along with indications of related body organs and/or symptoms to be treated or relieved by applying physical pressures thereon.

Based on the reflexology techniques, acupressure therapists often press such acupressure points in the feet of their patients using tools (such as wooden sticks) and fingertips, for example, using the distal tip areas of their thumbs, index and middle fingers. However, such acupressure treatments require specialized acupressure and reflexology skills and techniques by the specialists thereof. They also need regular, repetitive, and time and efforts consuming works to achieve their intended objectives of the acupressure treatments.

As one example of such acupressure devices, an acupressure mat is known in the art, which has a plurality of upward projections arranged on the mat in regular pattern, for example, by arranging the projections aligned in multiple rows and columns. The acupressure mat is often put on the floor in front of a kitchen sink to provide acupressure stimulations on the feet of the users doing the kitchen work while standing on the mat. Another known acupressure device is a pair of sandals or slippers with a plurality of upward projections arranged on the upper sole surface in regular pattern to provide acupressure effects on the wearer. These acupressure devices may provide beneficial massage effects to a certain degree. However, it may be difficult to obtain noticeable therapeutic results to the users as the optimal acupressure points for the particular persons cannot effectively be pressed or stimulated due to the limitations by the regularly arranged pattern of the projections since the pattern does not match or correspond to the specific acupressure points of the feet.

SUMMARY OF THE INVENTION

Accordingly, in consideration to handle or overcome aforementioned and other shortcomings of the conventional acupressure devices and techniques thereof, the present invention is directed to novel systems and related methods thereof, that are capable of providing effective acupressure stimulations onto the human feet utilizing pressurized spraying water, more particularly, by squirting pressurized water directed through a plurality of nozzle holes that are directed to specific acupressure points of the feet, thereby, effectively providing therapeutic and healing effects to the human body, such as relaxing the body, promoting blood circulation, and reducing body pains, and relieving abnormal symptoms, and so on.

According to an aspect of the invention, an acupressure apparatus includes a tub having a side wall member and a bottom wall member and configured to receive the feet of a user in the tub for acupressure treatment; an acupressure station positioned in the tub, the acupressure station having a pair of designated foot placing areas for facilitating accurate positioning of the feet of the user on the acupressure station for acupressure treatment, a plurality of upward projections of predetermined heights formed on an upper surface of the acupressure station, and a plurality of watering holes formed in the upper surface of the acupressure station beside the projections; and a water supply conduit connected to the bottom wall member of the tub for supplying compressed water by operation of a water pump connected to the water supply conduit. The watering holes formed in the upper surface of the acupressure station are directed to acupressure points of the feet such that the compressed water delivered through the watering holes of the acupressure station provides acupressure stimulations to the acupressure points of the feet.

According to one preferred embodiment, the acupressure station of the apparatus has a water distribution pipe system coupled thereto, and the water distribution pipe system includes at least one main conduit of bigger conduit size, and a plurality of branch conduits of smaller conduit size in fluid communication with the main conduit, with said branch conduits being connected, in fluid communication, to the plurality of watering holes.

The main conduit of the water distribution pipe system may include a central conduit running outwardly from a central area and a circumferential conduit running along a circumferential area, and the branch conduits are directed in radially inward directions from the circumferential conduit.

According to another preferred embodiment, the acupressure station of the apparatus includes an upper panel having a plurality of upward projections and a plurality of watering holes on an upper surface of the upper panel, and a lower panel securely attached under the upper panel, with a water chamber defined between the upper panel and the lower panel, and wherein the water chamber is in fluid communication with the plurality of watering holes.

The upper panel preferably has a planar lower surface, and the lower panel has a raised flange area and a lowered base portion which forms the water chamber when the lower panel is securely attached under the upper panel.

DETAILED DESCRIPTION OF THE INVENTION

With reference to the drawings, an acupressure apparatus, in particular, a foot acupressure apparatus of the present invention, and components for the apparatus are described and illustrated herein according to the principles of the invention. Even though the present invention is particularly described in connection with a foot acupressure apparatus and related methods thereof, it is not limited thereto and may be applied to other similar acupressure apparatuses, such as a hand acupressure apparatus utilizing the same and similar acupressure principles and concepts disclosed in this application, or that can otherwise be derived or recognizable, without undue experiments, upon reading the full disclosure of the application. Thus, it is intended that the foot acupressure apparatus and related methods of foot care described in this invention disclosure can also be used for similar acupressure apparatuses and associated methods for treating other body parts such as hands.

Figure 1:
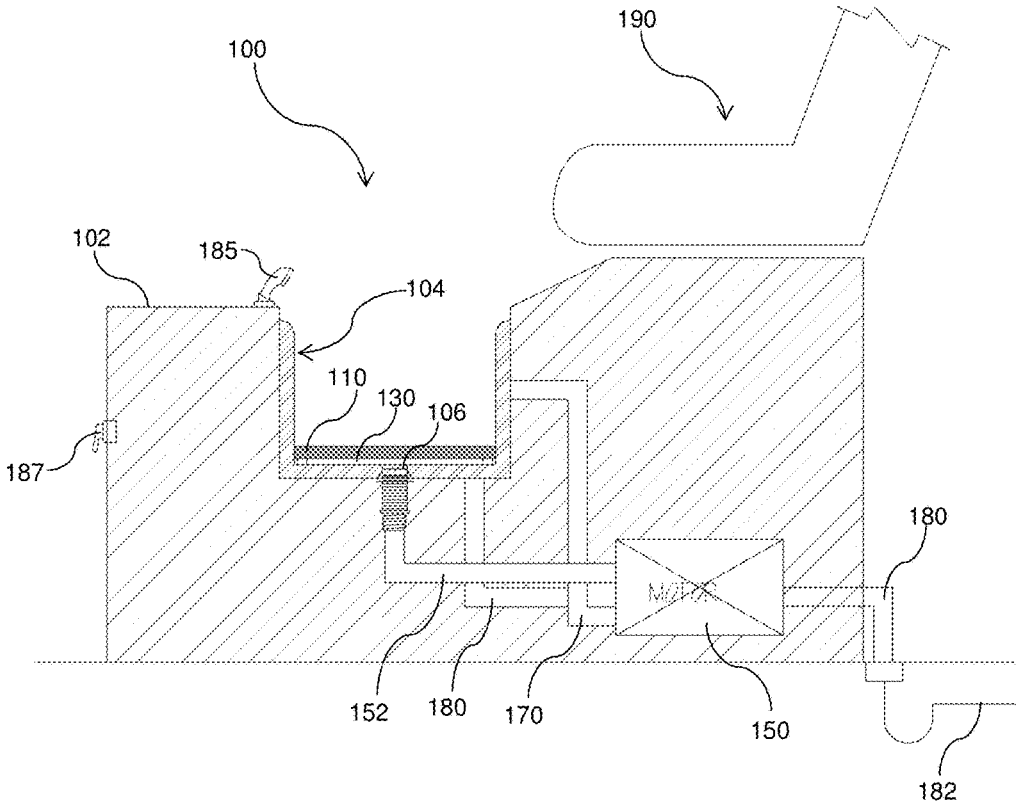
FIG. 1 is a schematic and partially cross-sectional representation of an acupressure apparatus, constructed according to one preferred embodiment of the present invention.
Figure 2:
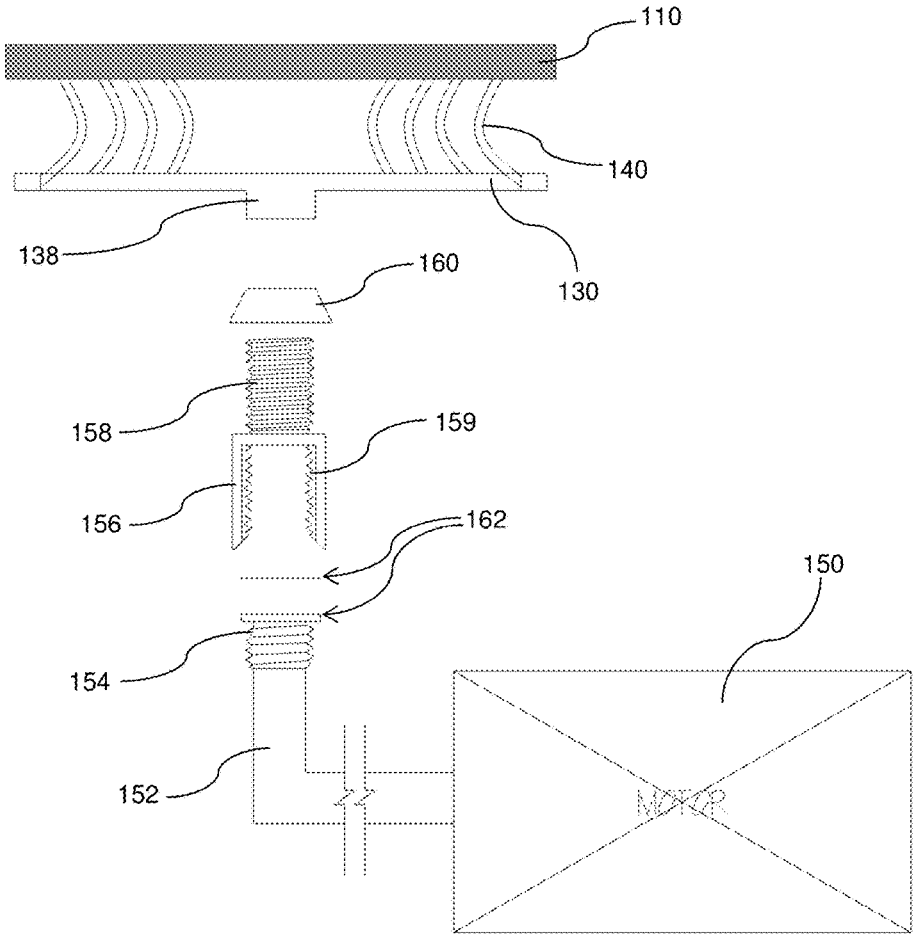
FIG. 2 is an exploded view, in schematic representation, of a portion of the acupressure apparatus of FIG. 1, illustrating the principles and major components of the apparatus.
Figure 3:
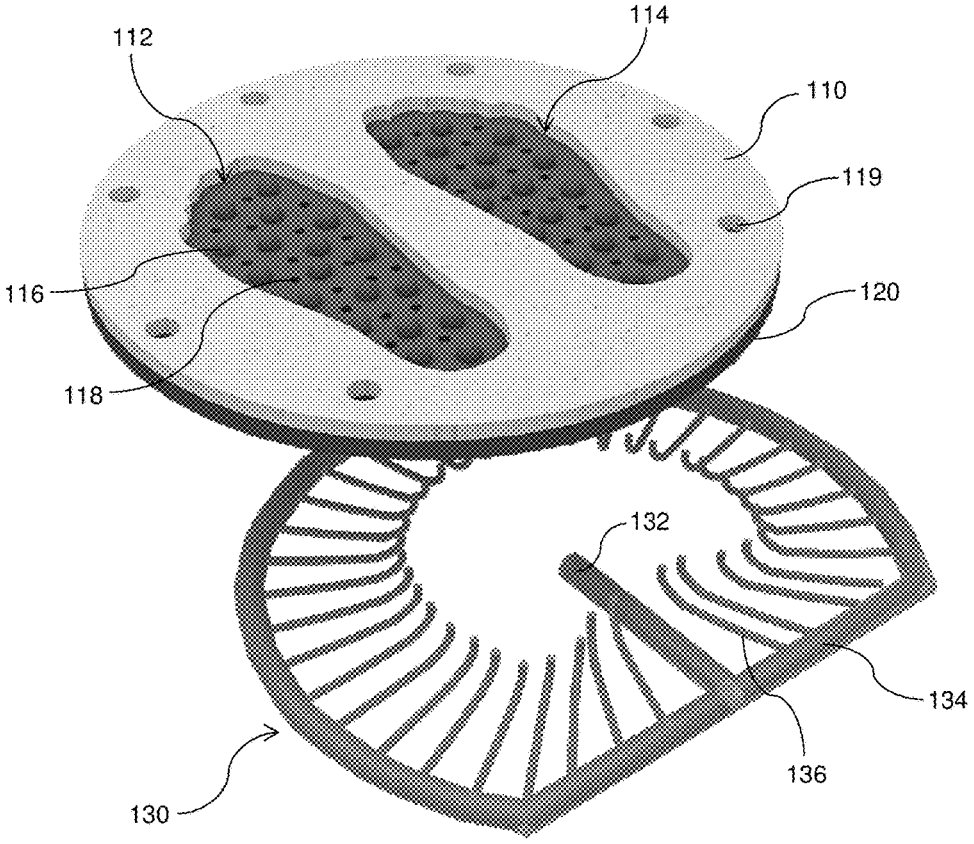
FIG. 3 is a perspective view illustrating portions of the acupressure station and the water distribution pipe system of the acupressure apparatus of FIG. 1.

Referring to FIGS. 1-3, the acupressure apparatus according to one preferred embodiment of the present invention is depicted and described herein for illustrating the principles of the invention and main components of the apparatus. It is noted that the acupressure apparatuses of the present invention (including the embodiments of FIGS. 4-8) can be constructed and suitably used as a part of commercial pedicure and/or spa operations, or they can be constructed for personal health and foot care uses at home.

The acupressure apparatus 100 includes a housing 102 of desired appearance, which is configured to install or accommodate components and parts of the apparatus thereto for the acupressure operation. A tub or foot compartment 104 is disposed at a suitable location on the housing 102. A user occupying seat 190, preferably having a bottom cushion, a pair of arm rests, and back support, is optionally disposed at the upper side of the housing 102 for facilitating adequate placement of its feet in tub 104 while the user is seated on the seat 190. A water faucet 185 is preferably provided for supplying warm or cold water to the tub 104 to wash the feet of the user and for subsequent acupressure operations in wet environment (if preferable) while placing the feet in the warm water filled in the tub, which will be described later in detail. The apparatus may optionally include a connection port 187 for hooking the apparatus to the hot/cold water lines of the house or facility having furnace/heater (not shown) for heating the water. Otherwise, the apparatus may have a heater (not shown) installed in the housing 102 to provide heated water for the acupressure operation.

For the acupressure operation of the device, a water supply motor or pump 150 and associated plumbing components for the operation are located within housing 102 for providing and discharging the water to and from the apparatus. Such plumbing components include a water supply pipe 152 for providing compressed water delivered from the pump 150 to the bottom hole 106 of the tub 104, which water will be subsequently directed to the acupressure station as will be described below in detail.

The tub 104 has a water circulation pipe 170 connected to a side wall of the tub at predetermined height from the bottom inner surface of the tub, and the water circulation pipe 170 is used for circulating the water in the tub back to a water reservoir (not shown) in the housing 102, which water is subsequently filtered by a filter (not shown), and is reused and redirect to the acupressure station through the water supply pipe 152 by operation of the pump 150. The water circulation pipe 170 is useful for the wet operation of the device, operating the acupressure apparatus while placing the feet of the user in the tub filled with the water. The wet operation is recommended to prevent the pressurized water from splashing out of the apparatus. However, the present invention is not intended to be limited thereto, and the apparatus can be operated in a dried state, that is, operating the acupressure apparatus without filling the water in the tub 104. For the dry operation, it is recommended to have suitable coverings or curtain securely installed in the tub around the feet in order to prevent the pressurized water spray from splashing out of the apparatus.

The apparatus further includes a drain pipe 180 connected to the bottom wall of the tub 104 to drain the used water from the apparatus through drain line 182 after completion of the acupressure operation.

The apparatus may optionally include a control device (not shown), such as micro-computer or other programmable control device, for appropriate operation of the acupressure apparatus, and a temperature controller (not shown) for heating and maintaining the water in the bathtub to a suitable temperature for bathing and acupressure operation.

The acupressure station and associated components of the apparatus are described below with reference to FIGS. 2 and 3 in particular.

The acupressure station includes an acupressure panel, which is typically composed of an upper panel 110 and a base panel 120 coupled together by bolts and nuts (not shown) that are secured via a plurality of screw holes 119. The bolts and nuts can be regular bolts and nuts, such as standard bolts and nuts which require screwing tools for installment, or they can be special fasteners such as wing bolts and wing nuts conveniently used for easy screwing and unscrewing operation by hand.

As shown in FIG. 3, the upper panel 110 includes a pair of footing holes 112 and 114 respectively having the shape of the left and right feet of the human to facilitate adequate positioning of the feet on the station, and the base panel 120 includes, within the footing hole areas, a predetermined number of bumps or projections 116 and a predetermined number of watering holes (or nozzles) 118 formed around the bumps on an upper surface of the base panel 120. The total number of the projections 116 in the two footing areas is preferably in a range between forty (40) and one hundred fifty (150). Each projection 116 preferably has a round bar shape of suitable size (e.g., ¼ to ½ inch diameter) with convex upper surface for contacting the feet, and with a height in a range from one third (⅓) to two third (⅔) inches, preferably, about one half (½) inch. Having the projections 116 of such optimal height, the bottom contact surface of the feet can maintain suitable gaps from the watering holes 118 of the apparatus. The user may optionally utilize the projections 116 as acupressure projections to apply acupressure stimulations on the feet by pressing the feet against the projections.

Figure 9:
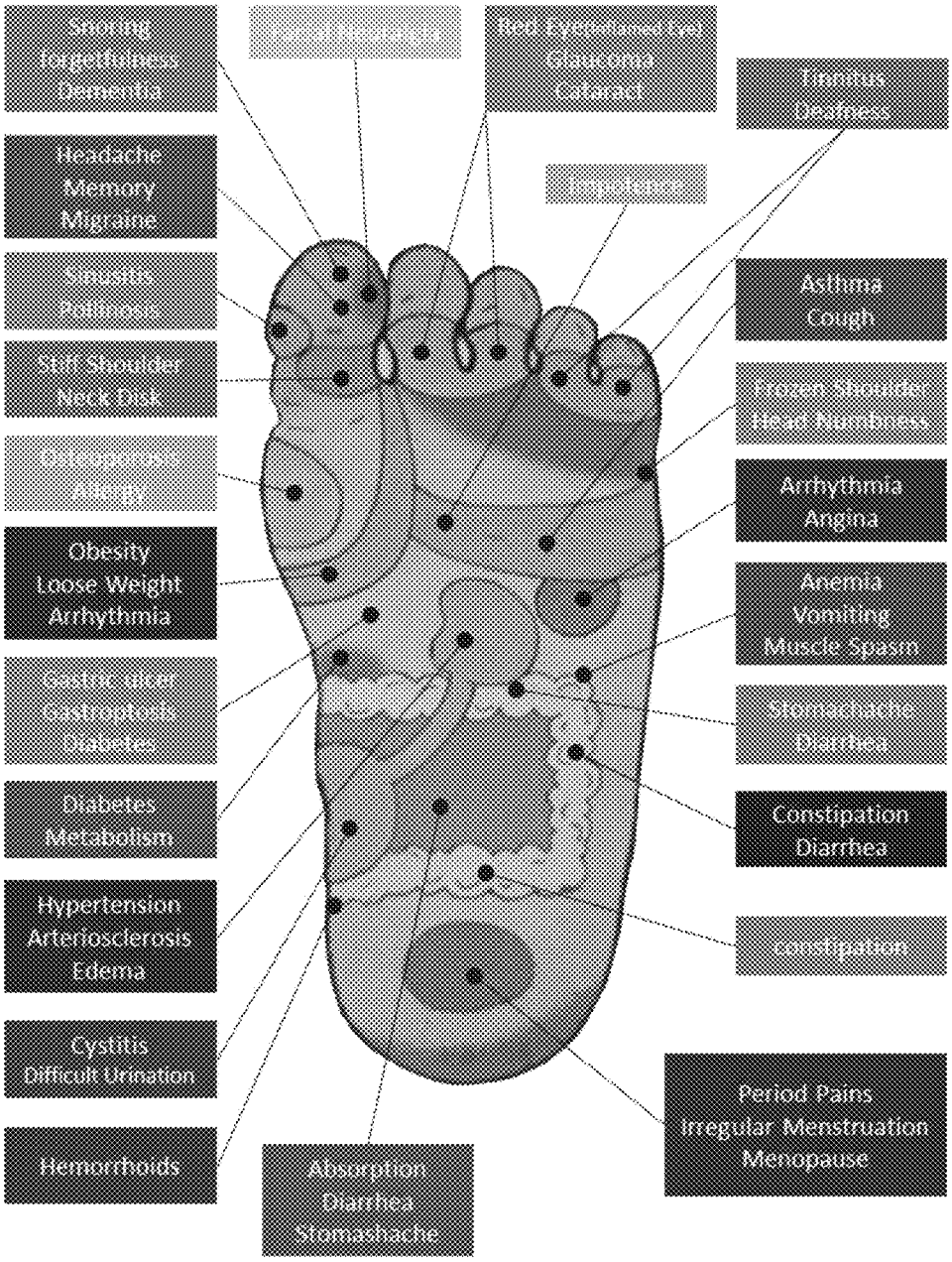
FIG. 9 illustrates a related foot reflexology chart showing acupressure points in the feet, along with indications of related body organs and/or symptoms to be treated or relieved by acupressure treatments.

The watering holes 118 are specifically located at, and oriented and directed to, the corresponding locations of the effective acupressure points of the feet that are recognized by the reflexology or acupressure sciences (see FIG. 9, for example). Each watering hole 118 has a hole diameter between about ⅛ to about ¼ inch, and the total number of the watering holes 118 in the two footing areas is preferably in a range between twenty (20) and ninety (90), more preferably, between fifth (50) and eighty (80). As described above, the water supplied to the acupressure station is compressed in operation by the pumping motor 150 to provide suitable acupressure stimulations to the acupressure points. The pressure of the water discharging at the watering holes is preferably in a range between 5 psi (above the local atmospheric pressure) and 35 psi (above the local atmospheric pressure), and the size of the holes are selected to have the optimal pressures in the discharging holes.

In the embodiment as shown, the acupressure station is formed of two panels (i.e., the upper and base panels 110 and 120) coupled together. However, the invention is not limited thereto, and the acupressure station can alternatively be formed of a single structure member (of moldable material, for example) with the footing areas (e.g., footing grooves) formed on its upper surface, and the projections and watering holes formed within the footing areas. The acupressure station (e.g., the upper and base panels 110 and 120) can be made of various known structural materials, for example, such as stainless steel, plastic materials, stones, marbles, and artificial marbles, and have the thickness and sizes suitable for the footing station of the apparatus. The acupressure station (e.g., the upper and lower panels 110 and 120) can be made of various known structural materials, for example, such as stainless steel, plastic materials, stones, marbles, and artificial marbles, and have the thickness and sizes suitable for the footing station of the apparatus.

A water distribution pipe system 130 is coupled under the acupressure station to provide pressurized water through the watering holes 118. The water distribution pipe system 130 includes one or more main tube members of bigger size and branch tube members of smaller size. In the embodiment as shown in FIG. 3, the main tube member of bigger size is composed of a central pipe 132 running outwardly from a central area of the device, and a circumferential pipe 134 connected to the central pipe 132 and running along a circumferential area thereof, for example, running in a circular or similar shape as illustrated. The branch tube members of smaller size are connected to the circumferential pipe 134, in fluid communication thereto, and they are directed in radially inward directions from the circumferential conduit to provide connections to the watering holes 118. The water distribution pipe system 130 may optionally include the same number of flexible connection tubes for the connection to their corresponding watering holes 118, as illustrated in FIG. 2.

The central pipe 132 of the water distribution pipe system 130 is connected to the water supply pipe 152 by suitable connection means known in the art. One preferable connection method is described below with reference to FIG. 2. As shown in FIG. 2, the central pipe 132 includes a connection port 138 with a female screw formed at a lower end thereof, to which a coupling male screw 158 of connection member 156 is connected by screw coupling. The connection member 156 further includes a female screw portion 159, which is in turn connected by screw coupling to a male screw portion 154 of the water supply pipe 152 through which pressurized water is supplied by operation of the pumping motor 150 to perform the acupressure treatment. In order to provide water-tight sealing to the plumbing components, the apparatus further includes several sealing members, such as sealing rings 162 placed between the juncture of the connection member 156 and the water supply pipe 152, and rubber seal 160 which is placed over the juncture of the connection port 138 and the male screw 158 and also inserted to the bottom hole 106 of the tub 104 (see FIG. 1).

Figure 4:
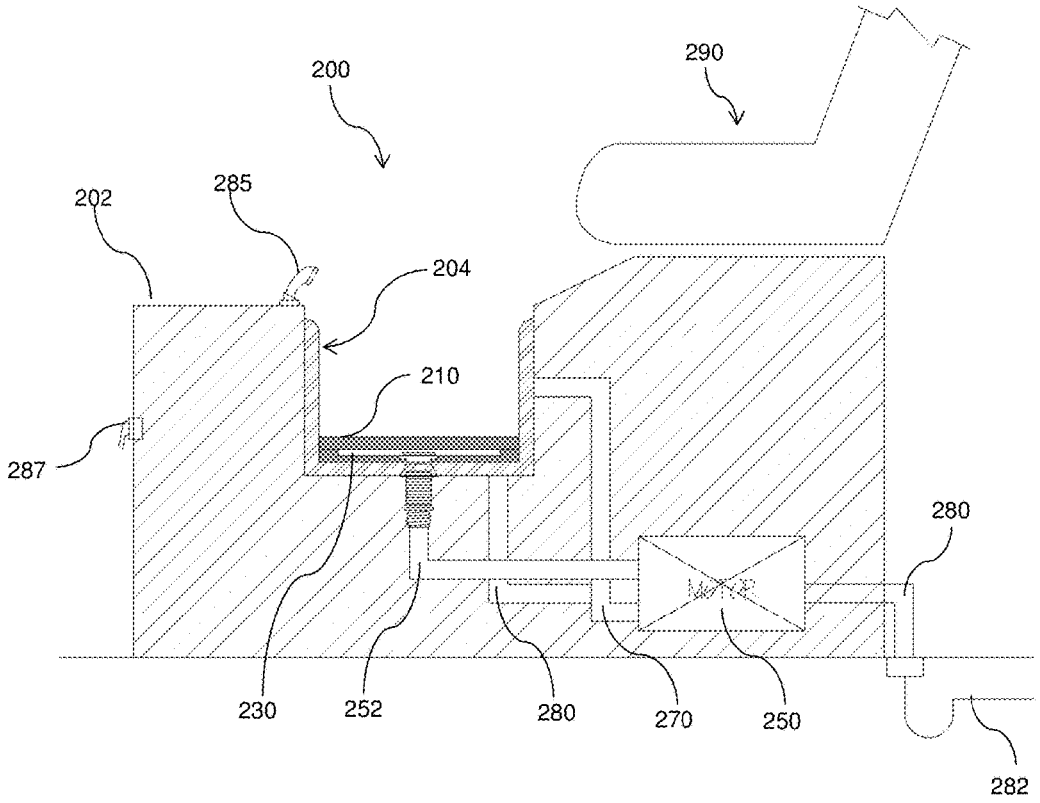
FIG. 4 is a schematic and partially cross-sectional representation of an acupressure apparatus, constructed according to another preferred embodiment of the present invention.
Figure 5:
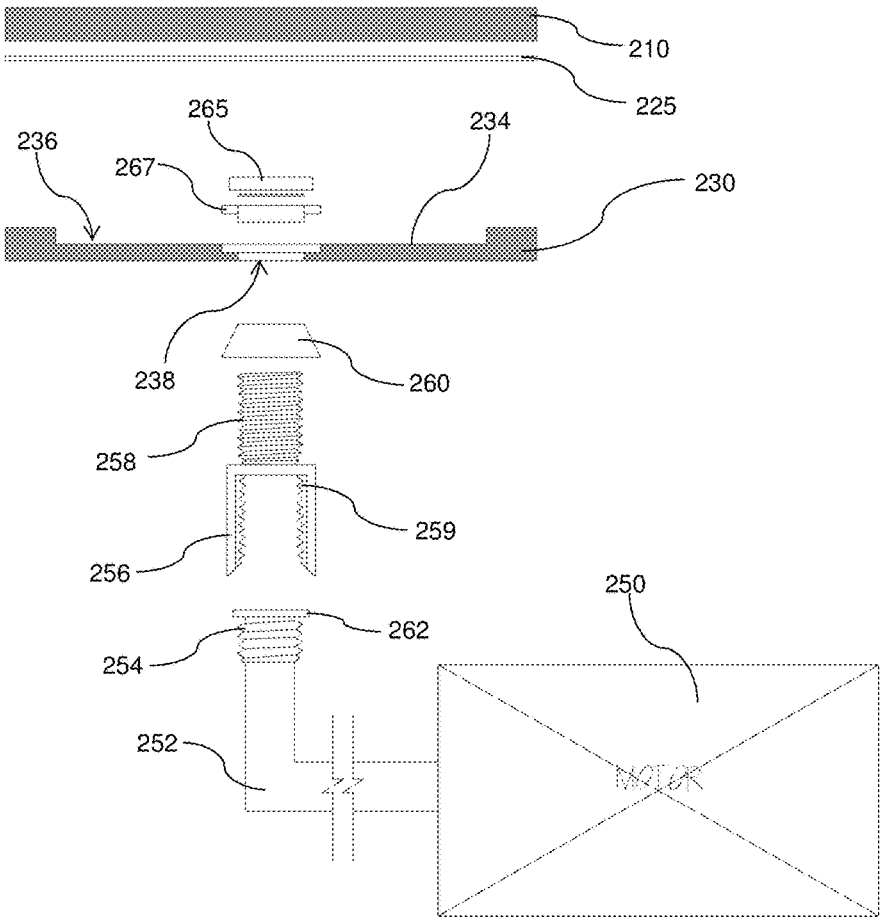
FIG. 5 is an exploded view of a portion of the acupressure apparatus of FIG. 4, illustrating the principles and major components of the apparatus.
Figure 6:
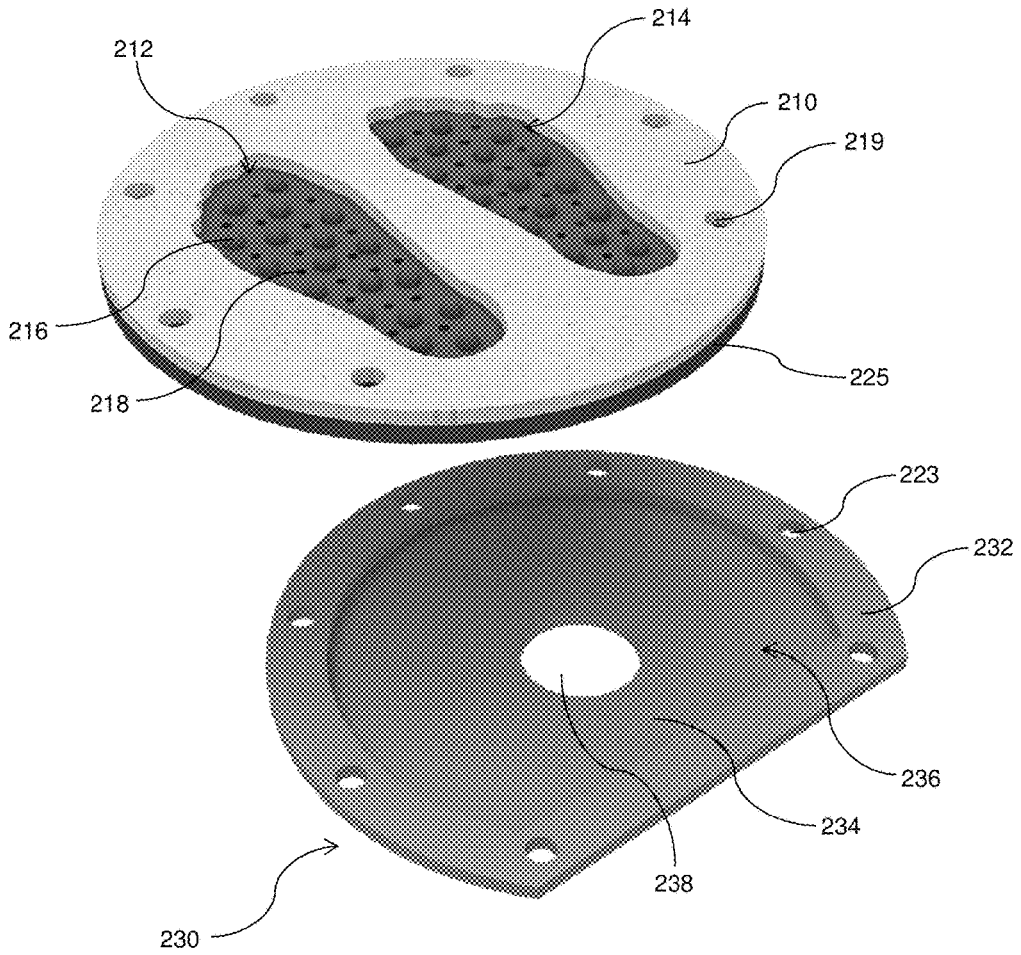
FIG. 6 is a perspective view illustrating a portion of the upper panel and the lower panel of the acupressure station of FIG. 4.

Referring now to FIGS. 4-6, the acupressure apparatus according to another preferred embodiment of the present invention is described herein.

The acupressure apparatus 200 includes a housing 202 of desired appearance, which is configured to install or accommodate components and parts of the apparatus thereto for the acupressure operation. A tub or foot compartment 204 is disposed at a suitable location on the housing 202. A user occupying seat 290, preferably having a bottom cushion, a pair of arm rests, and back support, is optionally disposed at the upper side of the housing 202 for facilitating adequate placement of its feet in tub 204 while the user is seated on the seat 290. A water faucet 285 is preferably provided for supplying warm (or cold) water to the tub 204 to wash the feet of the user and for subsequent acupressure operations in wet environment (if preferable) while placing the feet in the warm water filled in the tub. The apparatus may optionally include a connection port 287 for hooking the apparatus onto the hot/cold water lines of the house or facility having furnace/heater (not shown) for heating the water. Otherwise, the apparatus may include a heater (not shown) installed in the housing 202 to provide heated water for the acupressure operation.

For the acupressure operation, a water supply motor or pump 250 and associated plumbing components for the operation are located within lower housing 202 for providing and discharging the water to and from the apparatus. Such plumbing components include a water supply pipe 252 for providing compressed water delivered from the pump 250 to the bottom hole of the tub 204, which water will be subsequently directed to the acupressure station as will be described below in detail.

The tub 204 has a water circulation pipe 270 connected to a side wall of the tub at predetermined height from the bottom inner surface of the tub, and the water circulation pipe 270 is used for circulating the water in the tub 204 back to a water reservoir (not shown) of the housing 202, which water is subsequently filtered by a filter (not shown), and is reused and redirect to the acupressure station through the water supply pipe 252 by operation of the pump 250. The water circulation pipe 270 is useful for the wet operation of the device, which is operated while placing the feet of the user in the tub filled with the water. The wet operation is recommended to prevent the pressurized water from splashing out of the apparatus. However, the present invention is not intended to be limited thereto, and the apparatus can be operated in a dried state, that is, operating the acupressure apparatus without filling the water in the tub 204. For the dry operation, it is recommended to have suitable coverings securely installed in the tub around the feet in order to prevent the pressurized water spray from coming to splash out of the apparatus.

The apparatus further includes a drain pipe 280 connected to the bottom wall of the tub 204 to drain the used water from the apparatus through drain line 282 after completion of the acupressure operation.

The apparatus may optionally include a control device (not shown), such as micro-computer or other programmable control device, for appropriate operation of the acupressure apparatus, and a temperature controller (not shown) for heating and maintaining the water in the bathtub to a suitable temperature for bathing and acupressure operation.

The acupressure station and associated components of the apparatus are described below with reference to FIGS. 5 and 6 in particular.

The acupressure station includes an acupressure panel, which is typically composed of an acupressure panel 210 and a lower panel 230 coupled together by bolts and nuts (not shown) that are secured via a plurality of screw holes 219. The bolts and nuts can be regular bolts and nuts, such as standard bolts and nuts of various type which require screwing tools for installment, or they can be special fasteners such as wing bolts and wing nuts that can conveniently be used for easy screwing and unscrewing operation by hand.

Figure 7:
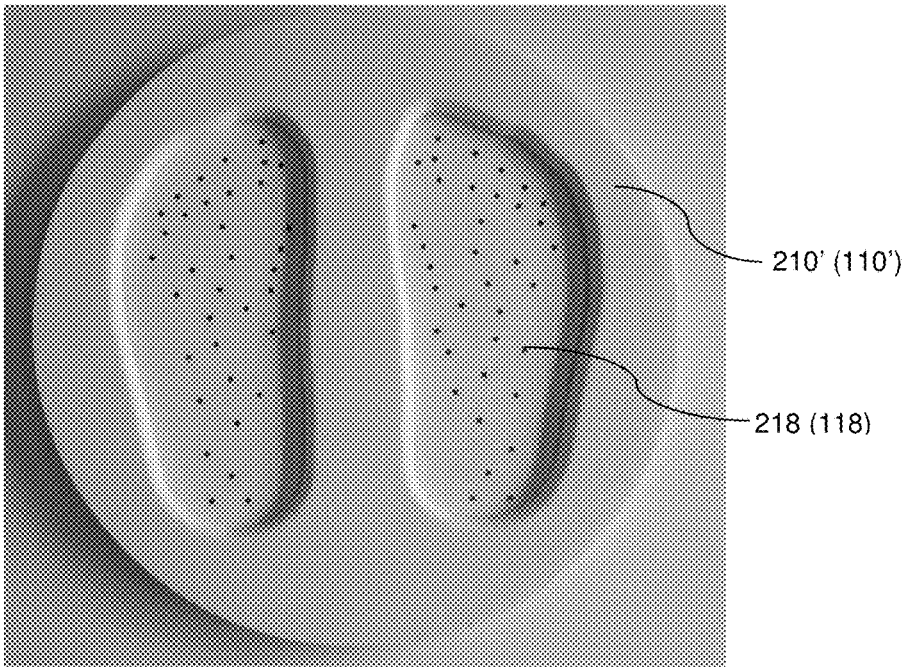
FIG. 7 is a photographic illustration of the upper surface of the acupressure station, in a state before attaching the projection members thereto.

As shown in FIG. 7, the acupressure panel 210 is formed of a single panel member, and includes a pair of footing grooves 212 and 214 formed in the upper face of the panel, the grooves 212 and 214 respectively having the shape of the left and right feet of the average person in order to facilitate adequate positioning of the feet on the station. Within the footing groove areas of the acupressure panel 210, a predetermined number of bumps or projections 216 and a predetermined number of watering holes (or nozzles) 218 are formed around the bumps on an upper surface of the panel. Each projection 216 preferably has a round bar shape of suitable size (e.g., ⅓ to ½ inch diameter) with convex upper surface for contacting the feet, and with a height in a range from one third (⅓) to two third (⅔) inches, preferably, about one half (½) inch.

It is further noted that the acupressure panel 210 may alternatively be constructed with two panel members combined together, namely, with the upper panel member (with a pair of footing holes therein) and the base panel member (with the projections and watering holes therein) attached under the upper panel in a manner similar to the previous embodiment of FIG. 3. The watering holes 218 are specifically located at, and directed toward, the corresponding locations of the effective acupressure points of the feet that are recognized by the reflexology or acupressure sciences (see FIG. 9, for example). The total number of the watering holes 218 in the two footing areas is preferably in a range between twenty (20) and ninety (90), more preferably, between fifth (50) and eighty (80). As described above, the water supplied to the acupressure station is compressed in operation by the pumping motor 250 to provide suitable acupressure stimulations to the acupressure points. The pressure of the water discharging at the watering holes is preferably in a range between 5 psi (above the local atmospheric pressure) and 35 psi (above the local atmospheric pressure), and the size of the holes are selected to have the optimal pressures in the discharging holes.

The lower panel 230 includes a raised planar flange portion 232 with screw holes 219 formed there-through for coupling the lower panel to the acupressure panel 210 with bolts and nuts (not shown), and a planar base panel portion 234 with vacant chamber space 236 to be formed between the two panels 210 and 230 when they are assembled into a unit.

The acupressure station (e.g., the panels 210 and 230) can be made of various known materials such as stainless steel, plastic materials, stones, marvels, and artificial marvels, and have the thickness and sizes suitable for the footing station of the apparatus.

A sealing 225 (e.g., water-proof packing or seal, and O-ring, etc.) is securely placed between the two panels 210 and 230 to provide water-proof engagement when the panels are secured by the fasteners. A central hole 238 is formed through the planar base portion 234, to which the plumbing components to be described below are to be connected.

As shown in FIGS. 4 and 5, an annular ring member 265 is tightly fitted to the central hole 238 of the lower panel 230 with annular rubber seal 267 engaged there-between. The annular ring member 265 includes a central through hole for allowing water passage there-through, and is tightly coupled to the water supply pipe 252 by suitable connection means known in the art. One preferable connection method is described below with reference to the drawings. The annular ring member 265 preferably includes a female formed in the inner hole, and a coupling male screw 258 of connection member 256 is screw coupled to the female screw of the annular ring 265. The connection member 256 further includes a female screw portion 259, and which is in turn connected by screw coupling to a male screw portion 254 of the water supply pipe 252 through which pressurized water is supplied by operation of the pumping motor 250 to perform the acupressure treatment. In order to provide water-tight sealing to the plumbing components, the apparatus further includes several sealing members, such as sealing ring 262 placed between the juncture of the connection member 256 and the water supply pipe 252, and rubber seal 260 which is placed over the juncture of the annular ring member 265 and the male screw 258 and also inserted to the bottom hole of the tub 204 (see FIG. 4).

It is further noted that the foot size of the users can be varied. In order to adequately positioning the feet, the acupressure stations can be made to have different footing sizes. For example, their footing holes (or grooves) 212 and 214 can be made into several standardized sizes (e.g., small, medium, large, and extra-large, etc.), or into specific foot-size ranges (e.g., 130-140 mm, 140-150 mm, 150-160 mm, 160-170 mm, etc.). In this manner, the acupressure station of desired size can be selected by the individual user. Thus, it will be beneficial to make the acupressure panel 210 easily interchangeable in order to accommodate different foot sizes. Accordingly, it is preferable that the apparatus uses special fasteners (not shown), such as wing bolts and wing nuts, that are to be easily coupled into the screw holes 219 by hand without using screwing/unscrewing tools.

Figure 8:
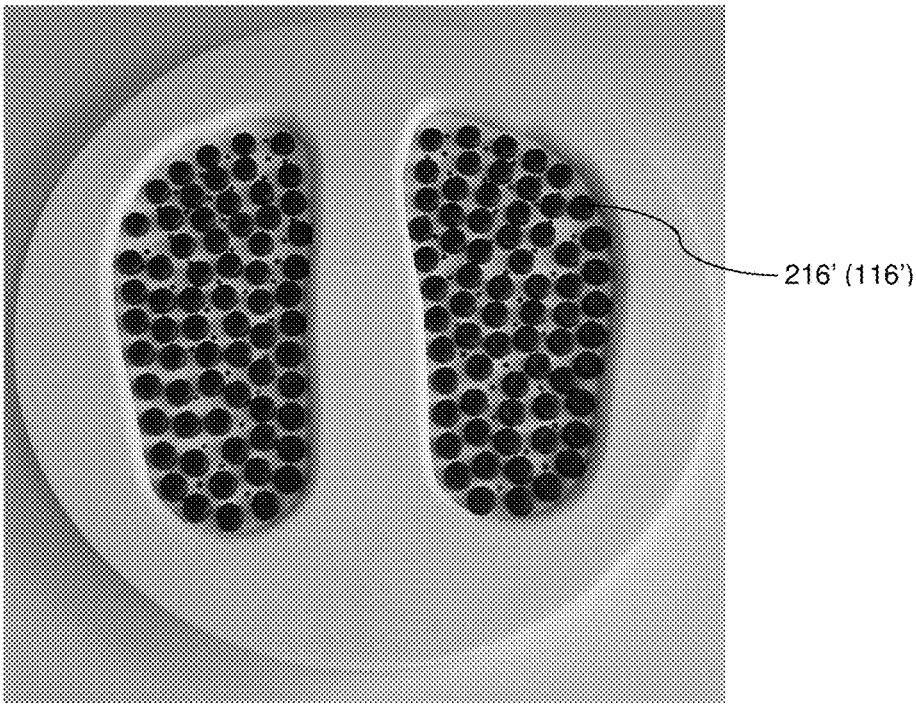
FIG. 8 is a photographic illustration of the upper surface of the acupressure station, in a state after attaching the projection members thereto.

FIGS. 7 and 8 illustrates another exemplary embodiment of the acupressure panel member of the acupressure station, in which FIG. 7 is a photographic illustration of the acupressure panel in a state before attaching the projection members thereto, and FIG. 8 is a photographic illustration of the upper panel in a state after attaching the projection members thereto. In this embodiment, the panel 210' (or 110') is made of plastic materials or artificial stone (e.g., artificial marble) and molded into one single member, and a plurality of watering holes 218 (or 118) are formed at, and directed to, the corresponding acupressure points of the feet known in the acupressure science as described before. Here, the locations of the watering holes are selected in light of the foot reflexology chart of FIG. 9, however, adding slightly more effective acupressure locations thereto further in view of other similar foot reflexology charts known in the related science.

According to this embodiment, the acupressure panel 210' is preferably coupled to the lower panel (e.g., 230) by connection methods other than the conventional bolt-and-nut type connection utilizing the screw holes 219 (see FIG. 6). For example, the acupressure panel 210' and the lower panel 230' can include a male screw and a mating female screw, respectively, around the side circumferences thereof, that can be used for screw coupling the two panels to make the acupressure station. For another example, the acupressure panel 210' and the lower panel can include bayonet type connection means (not shown) around the corresponding side circumferences of the upper and lower panels, which can be used for rotating-coupling to form the acupressure station. This type of alternative connection methods (other than the conventional bolt-and-nut connection) may be useful as the connection can be made easily by hand without using special tools such as screw drivers or wrenches.

It is further noted that the acupressure station and/or the upper panel (e.g., panel 210 and 110) can alternatively have different footing configurations other than the footing grooves or footing holes as shown in FIGS. 3 and 6. For example, the upper panel can have line drawings, imprints, or other known indicia showing the shape of the feet, which can be used to facilitate placing of the feet at adequate locations for the acupressure treatment.

It is further noted that the footing surface areas on which the projections (116, 216) and the watering holes (118, 218) are formed, are shown to have a flat or planar surface in the preferred embodiments disclosed above. However, each footing area can alternatively have a curved surface corresponding to the bottom surface of the human feet. The projections (116, 216) and the watering holes (118, 218) can also be formed in perpendicular directions relative to the particular surface curvature where the projections and holes are located.

As described above, the acupressure apparatus of the present invention is preferably used in wet operation condition, namely, by performing the acupressure treatment while placing the feet in the warm water filled in the tub and circulating the water utilizing the water recirculation pipe (170, 270). In operation, the water temperature for the acupressure treatment is preferably to be set in a range between 35-45° C., or cooler if the user prefers, and the optimal operation time is set for 10-20 minutes, or longer depending on the preference of the user, in order to maximize the acupressure effects.

While preferred embodiments of the present invention have been shown and described, it will be apparent to those skilled in the art that many changes and modifications may be made without departing from the invention in its broader aspects. The appended claims are intended to cover, therefore, such changes and modifications as fall within the true spirit and scope of the invention.

What is claimed is:

1. An acupressure apparatus comprising:

a tub having a side wall member and a bottom wall member and configured to receive feet of a user in the tub for acupressure treatment;

an acupressure station positioned in the tub, the acupressure station including an upper panel with a pair of foot receiving openings of foot shape formed through the upper panel, and a base panel coupled to a bottom surface of the upper panel, thereby providing a pair of designated foot placing areas defined by the foot receiving openings of the upper panel for facilitating accurate positioning of the feet of the user in the foot receiving openings of the acupressure station for acupressure treatment, wherein the acupressure station includes a plurality of upward projections of predetermined heights formed on an upper surface of the base panel of the acupressure station, and a plurality of watering holes formed in the upper surface of the base panel of the acupressure station beside the projections; and a water supply conduit connected to the bottom wall member of the tub for supplying compressed water to the watering holes of the base panel by operation of a water pump connected to the water supply conduit, wherein the watering holes formed in the upper surface of the base panel of the acupressure station are accurately directed to acupressure points of the feet due to the aid of the pair of foot receiving openings of the upper panel such that the compressed water delivered through the watering holes of the acupressure station provides acupressure stimulations to the acupressure points of the feet.

2. The acupressure apparatus of claim 1, wherein the number of total watering holes of the acupressure station is in a range between twenty (20) and ninety (90).

3. The acupressure apparatus of claim 1, wherein the acupressure station has a water distribution pipe system coupled thereto, and the water distribution pipe system includes at least one main conduit of bigger conduit size, and a plurality of branch conduits of smaller conduit size coupled to the main conduit in fluid communication with the main conduit, with said branch conduits being connected, in fluid communication, to the plurality of watering holes.

4. The acupressure apparatus of claim 3, wherein the main conduit of the water distribution pipe system includes a central conduit running outwardly from a central area and a circumferential conduit running along a circumferential area, and the branch conduits are directed in radially inward directions from the circumferential conduit.

5. The acupressure apparatus of claim 3, further comprising a water circulation conduit connected in fluid communication with the tub, said water circulation conduit configured to intake water contained in the tub by operation of the water pump to transfer the water to a water reservoir or to the water pump for reuse.

6. The acupressure apparatus of claim 3, wherein the acupressure station further comprises a plurality of flexible connection tubes in the same number with the number of the watering holes, the flexible connection tubes are connected to the branch conduits to direct the water to the plurality of watering holes.

7. The acupressure apparatus of claim 1, wherein the acupressure station further includes a lower panel securely attached under the base panel, with a water chamber defined between the base panel and the lower panel, and wherein the water chamber is in fluid communication with the plurality of watering holes.

8. The acupressure apparatus of claim 7, wherein the base panel has a planar lower surface, and the lower panel has a raised flange area and a lowered base portion which forms the water chamber as the lower panel is securely attached under the base panel.

9. The acupressure apparatus of claim 7, wherein the lower panel includes a central hole to which an annular ring member are coupled, and wherein the water supply conduit is connected to the annular ring member to supply the water through an inner hole of the annular ring member.

10. The acupressure apparatus of claim 7, further comprising a water circulation conduit connected in fluid communication with the tub, said water circulation conduit configured to intake water contained in the tub by operation of the water pump to transfer the water to a water reservoir or to the water pump for reuse.

11. The acupressure apparatus of claim 7, the base and lower panels of the acupressure station include multiple screw holes to couple the base and lower panels by bolts and screws.

12. The acupressure apparatus of claim 7, each of the base and lower panels has a circular shape with circumferential screw formed along the circumference thereof and configured to couple the base and lower panels by the circumferential screw.

13. The acupressure apparatus of claim 7, the base and lower panels of the acupressure station are coupled by bayonet type connection.

14. The acupressure apparatus of claim 7, further comprising a water-tight sealing placed between the base and lower panels of the acupressure station.

15. An acupressure apparatus comprising:

a tub having a side wall member and a bottom wall member and configured to receive feet of a user in the tub for acupressure treatment;

an acupressure panel positioned in the tub, the acupressure panel including a pair of foot receiving grooves of foot shape formed in an upper surface of acupressure panel for facilitating accurate positioning of the feet of the user in the foot receiving grooves of the acupressure panel for acupressure treatment, and a lower panel coupled to a bottom surface of the acupressure panel, wherein the acupressure panel includes a plurality of upward projections of predetermined heights formed on an upper surface of the acupressure panel, and a plurality of watering holes formed in the upper surface of the acupressure panel beside the projections; and a water supply conduit connected to the bottom wall member of the tub for supplying compressed water to the watering holes of the base panel by operation of a water pump connected to the water supply conduit, wherein the watering holes formed in the upper surface of the acupressure panel are accurately directed to acupressure points of the feet due to the aid of the pair of foot receiving grooves of the acupressure panel such that the compressed water delivered through the watering holes of the acupressure panel provides acupressure stimulations to the acupressure points of the feet, wherein the acupressure panel has a water distribution pipe system coupled thereto, and the water distribution pipe system includes at least one main conduit of bigger conduit size, and a plurality of branch conduits of smaller conduit size coupled to the main conduit in fluid communication with the main conduit, with said branch conduits being connected, in fluid communication, to the plurality of watering holes, wherein the main conduit of the water distribution pipe system includes a central conduit running outwardly from a central area and a circumferential conduit running along a circumferential area, and the branch conduits are directed in radially inward directions from the circumferential conduit.

* * * * *